US007241003B2

(12) United States Patent
Fellingham et al.

(10) Patent No.: US 7,241,003 B2
(45) **Date of Patent: *Jul. 10, 2007**

(54) MEDIA DRYING SYSTEM HAVING A HEATED SURFACE AND A DIRECTED GAS FLOW

(75) Inventors: Peter J. Fellingham, San Diego, CA (US); Shawn J. Mercy, San Diego, CA (US); David A. Neese, Escondido, CA (US)

(73) Assignee: Eastman Kodak Company, Rochester, NY (US)

( * ) Notice: Subject to any disclaimer, the term of this patent is extended or adjusted under 35 U.S.C. 154(b) by 275 days.

This patent is subject to a terminal disclaimer.

(21) Appl. No.: 10/753,245

(22) Filed: Jan. 8, 2004

(65) Prior Publication Data

US 2005/0151816 A1 Jul. 14, 2005

(51) Int. Cl.

| | |
|---|---|
| ***B41J 2/01*** | (2006.01) |
| ***F26B 9/00*** | (2006.01) |
| ***F26B 13/00*** | (2006.01) |
| ***F26B 13/06*** | (2006.01) |

(52) U.S. Cl. ..... 347/102; 34/629; 34/633

(58) Field of Classification Search ..... 347/102, 347/101; 34/304, 418, 419, 420, 611, 612, 34/524, 523; 101/488

See application file for complete search history.

(56) References Cited

U.S. PATENT DOCUMENTS

| | | | | |
|---|---|---|---|---|
| 5,005,025 | A | 4/1991 | Miyakawa et al. | |
| 5,323,546 | A * | 6/1994 | Glover et al. | 34/267 |
| 5,399,039 | A * | 3/1995 | Giles et al. | 400/636 |
| 6,059,406 | A * | 5/2000 | Richtsmeier et al. | 347/102 |
| 6,256,903 | B1 | 7/2001 | Rudd | |
| 6,308,626 | B1 | 10/2001 | Crystal et al. | |
| 6,463,674 | B1 * | 10/2002 | Meyers et al. | 34/304 |
| 6,536,894 | B1 | 3/2003 | Rasmussen et al. | |
| 2003/0081097 | A1 | 5/2003 | Gil et al. | |
| 2003/0128253 | A1 | 7/2003 | Kitahara et al. | |
| 2003/0226276 | A1 | 12/2003 | Yonkoski et al. | |
| 2005/0150130 | A1 * | 7/2005 | Fellingham et al. | 34/624 |

FOREIGN PATENT DOCUMENTS

| | | |
|---|---|---|
| GB | 1 046 087 | 10/1966 |

* cited by examiner

*Primary Examiner*—Julian D. Huffman
(74) *Attorney, Agent, or Firm*—William R. Zimmerli

(57) ABSTRACT

A drying system and method are provided. The drying system includes a plenum and a gas source in fluid communication with the plenum. A gas flow guide is attached to the plenum and is operable to direct gas flow provided by the gas source. A support includes a surface, at least a portion of which is heated. The gas flow guide is positioned to direct gas flow at least partially toward the heated surface of the support.

22 Claims, 8 Drawing Sheets

MEDIA DRYING SYSTEM HAVING A HEATED SURFACE AND A DIRECTED GAS FLOW

CROSS REFERENCE TO RELATED APPLICATIONS

Reference is made to commonly assigned, U.S. patent Publication No. 2005/1050130 published Jul. 14, 2005, entitled "A MEDIA DRYING SYSTEM", in the name of Peter J. Fellingham, et al, filed Jan. 8, 2004.

FIELD OF THE INVENTION

This invention relates generally to the field of digitally controlled printing systems and, in particular, to the drying of printed media produced by these systems.

BACKGROUND OF THE INVENTION

Media drying systems are known. For example, U.S. Patent Application Publication No. 2003/0081097, published on May 1, 2003, discloses a heated media deflector for an inkjet printer. The media deflector is located in a transition area between a horizontal printing plane and a vertical feeding path. The media deflector includes a plastic support portion and a sheet metal portion with a heating resistor attached to a bottom surface of the sheet metal portion. The sheet metal portion provides a guiding surface for guiding a media from a printing zone to the vertical feeding path. The sheet metal portion of the heated media deflector also radiates heat that dries excess water absorbed by the media during printing. The inkjet printer includes a controller for controlling the heating temperature of the heated media deflector. The heating temperature is set based on environmental conditions and print job parameters.

Additionally, U.S. Pat. No. 5,005,025, issued to Miyakawa et al. on Apr. 2, 1991, discloses an ink jet recording apparatus that fixes ink through evaporation of a solvent portion of ink printed onto a recording element. The apparatus includes a recording head for ejecting ink onto the recording element. The recording head is positioned in an recording area of the apparatus. A heating member extends in an upstream and downstream direction relative to the recording area and contacts the recording element to assist in the fixation of the ink. The apparatus also includes a press plate disposed upstream of the recording area that presses the recording element against the heating member. The press plate has a portion opposed to the heating member and a plurality of slits spaced apart from each other in a direction perpendicular to a recording element travel direction.

U.S. Pat. No. 6,308,626, issued to Crystal et al. on Oct. 30, 2001, discloses a wide format thermal printing system providing directed fluid flow from specially-designed orifices which promote fluid flow on a printed surface of a recording media. One or more heating elements are inserted directly into the fluid flow promoting drying of the printed surface. The printing system includes a single dual duct plenum spans the width of a roll-fed wide format ink jet print engine. A first duct of the dual duct plenum distributes heated air in a direction of media web movement while a second duct evacuates a printing area of any potentially harmful ink vapors or other air-borne contaminant to either a remote exhaust vent or vapor capture vessel.

SUMMARY OF THE INVENTION

According to one feature of the present invention, a drying system includes a plenum and a gas source in fluid communication with the plenum. A gas flow guide is attached to the plenum and is operable to direct gas flow provided by the gas source. The drying system also includes a support having a surface, at least a portion of which is heated. The gas flow guide is positioned to direct gas flow at least partially toward the heated surface of the support.

According to another feature of the present invention, a method of drying media includes providing a surface, portions of the surface defining a media travel path; heating the portions of the surface defining the media travel path; and directing a gas flow at least partial toward the surface and at least partially along a direction of media travel.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
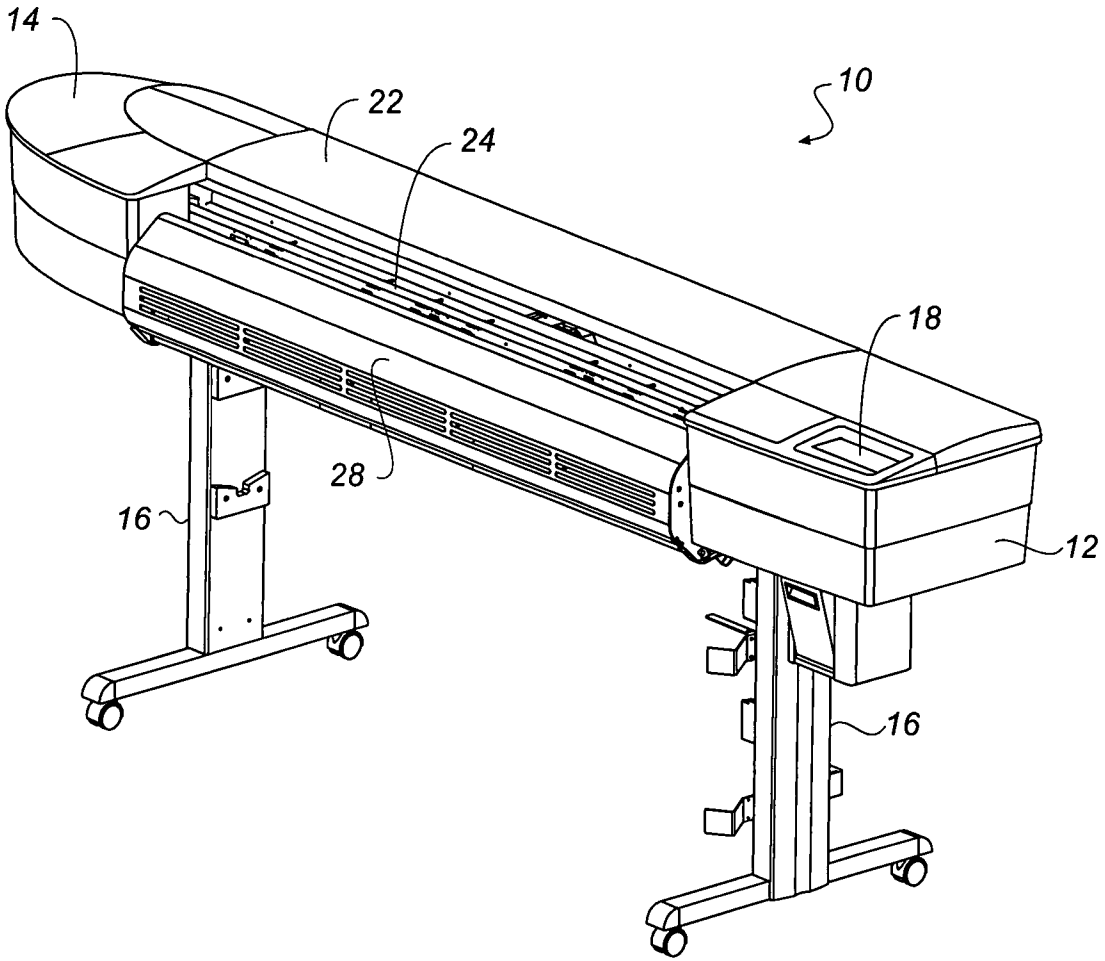
FIG. 1 is a perspective view of a printer incorporating a media drying system.

Referring to FIG. 1, an embodiment of a large format inkjet printer 10 includes right and left side housings 12, 14 and is supported by a pair of legs 16. The right housing 12 includes a control panel 18 for operator input and control and encloses various electrical and mechanical components related to the operation of the printer device. The individual components of control panel 18 can vary depending on the contemplated printing application and can include any combinations of an operator display, an operator keypad, temperature controls, operational controls, etc. The left housing 14 encloses ink reservoirs (not shown) which feed ink to at least one inkjet cartridge located on a print carriage (not shown) via plastic conduits (not shown) which run between each inkjet cartridge and each ink reservoir. In other printer embodiments, no separate ink reservoirs or conduit is provided, and printing is performed with ink reservoirs integral to inkjet cartridges located on the print carriage. The printer 10 also includes a cover 22.

Either a roll of continuous media (not shown), for example, paper, is mounted to a roller (not shown) on the rear of the printer 10 to enable a continuous supply of media to be provided to the printer 10 or individual sheets of media (not shown), for example, paper, are fed into the printer 10. A platen 24 forms a horizontal surface which supports the media and defines at least a portion of a travel path for the media. Printing is accomplished by select deposition of ink drops onto the media.

During operation, a supply of media is guided from the roll of paper or other media mounted to the rear of the printer 10 across platen 24 by a plurality of upper rollers (not shown) which are spaced along platen 24. In an alternate embodiment, single sheets of paper or other media are guided across the platen 24 by the upper rollers. A support structure (not shown) is suspended above platen 24 and spans its length with sufficient clearance between the platen 24 and the support structure to enable paper or other media which is to be printed on to pass between the platen 24 and the support structure.

The support structure supports the print carriage above platen 24. The print carriage, typically includes a plurality of inkjet cartridge holders (not shown), each with a replaceable inkjet cartridge mounted therein. The support structure generally comprises a guide rod positioned parallel to platen 24. The print carriage preferably comprises split sleeves which slidably engage the guide rod to enable motion of the print carriage along the guide rod to define a linear printing path along which the print carriage moves. A motor and a drive belt mechanism (not shown) located in right housing 12 are used to drive the print carriage (not shown) along the guide rod.

During printing, the print carriage passes back and forth over media supported by platen 24 selectively depositing ink on the media. This can be accomplished in any manner known in the printing industry, for example, a multi-pass printing mode, a single pass printing mode, etc. After the media has been printed, the media moves to and through a media drying system 28 positioned downstream from platen 24 relative to a direction of media travel.

Figure 2:
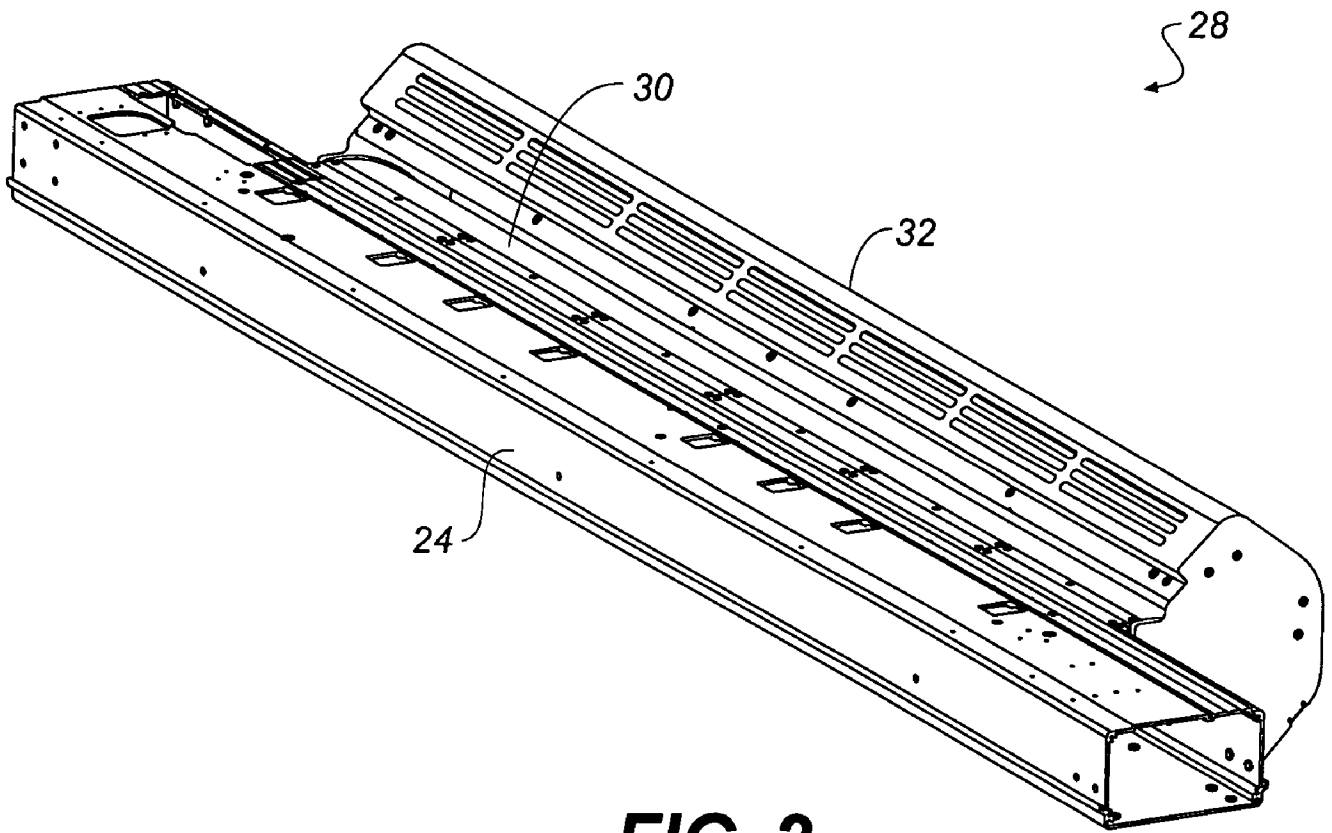
FIG. 2 is a perspective view of the media drying system and a platen assembly.

Referring to FIG. 2, media drying system 28 is shown attached to platen 24. Media drying system 28 includes two components—a media support 30 and a gas dryer 32. Support 30 is attached to a downstream end (relative to a direction of media travel) of platen 24 while gas dryer 32 is positioned adjacent to support 30 to direct a gas flow toward support 30.

Support 30 will be discussed in more detail below with reference to FIGS. 3–6. Gas dryer 32 will be discussed in more detail below with reference to FIGS. 7 and 8.

Figure 3:
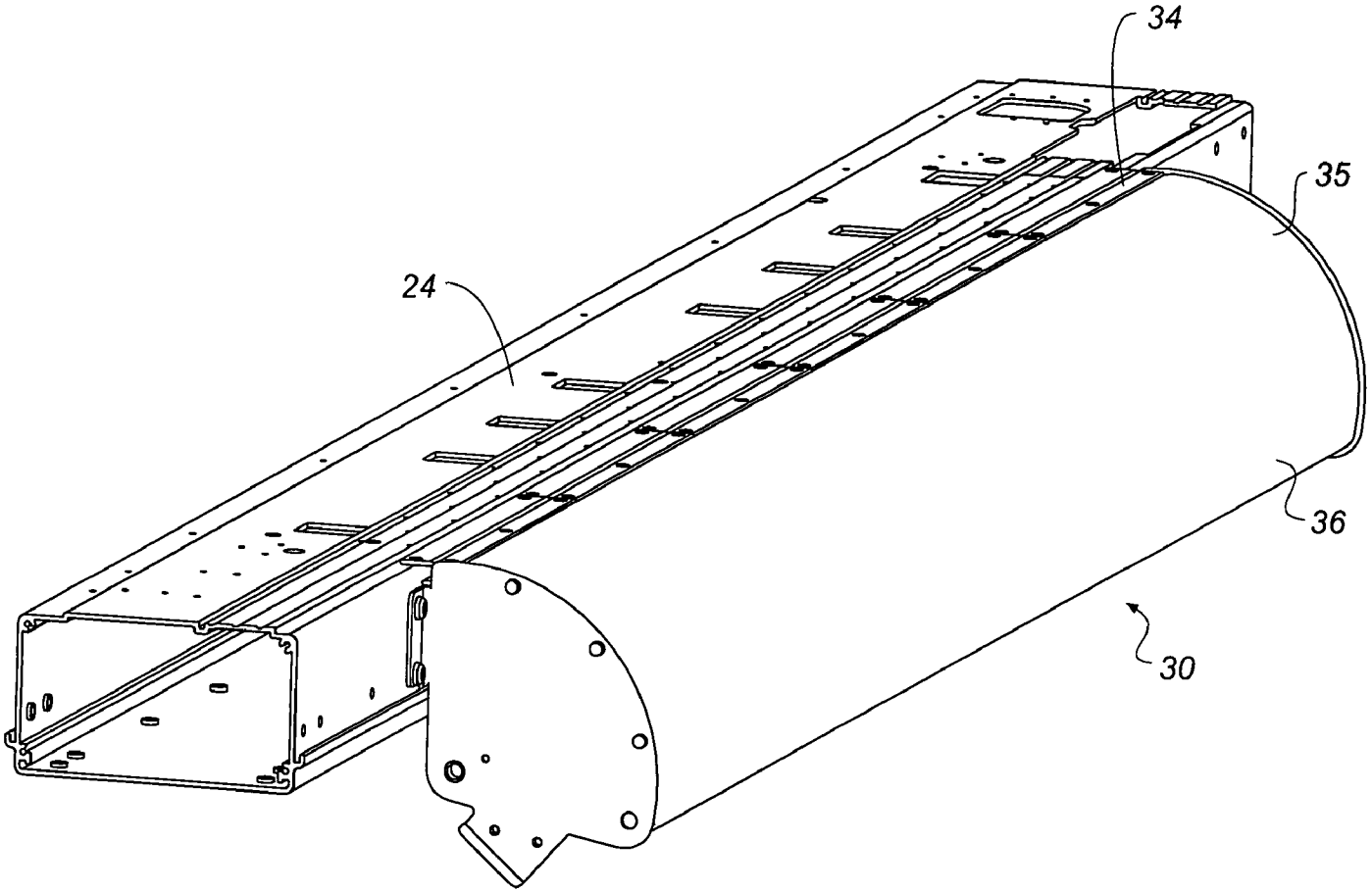
FIG. 3 is a perspective view of a first portion of the media drying system and the platen assembly.
Figure 4:
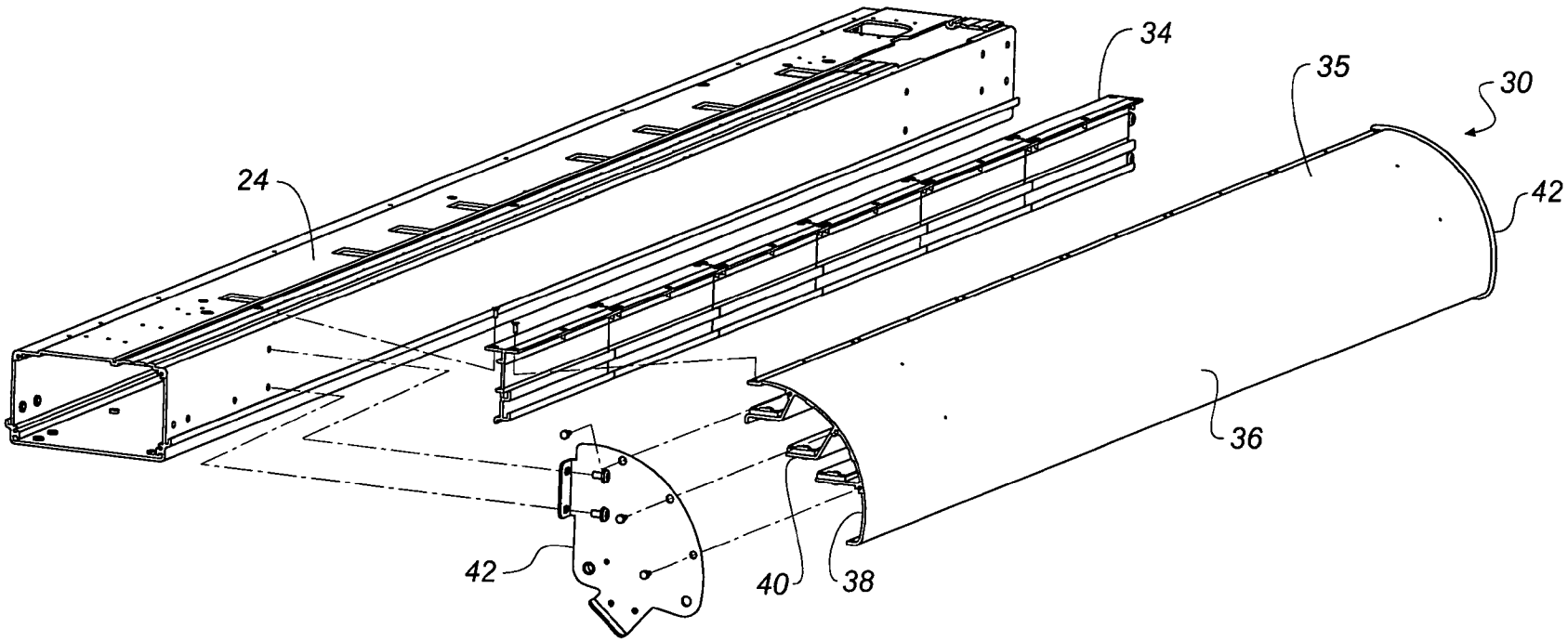
FIG. 4 is an exploded view of the first portion of the media drying system and the platen assembly.

Referring to FIGS. 3 and 4, support 30 has a body portion 35 including a first surface 36 and a second surface 38. A spacer 34 is positioned between platen 24 and support 30. Attached to platen 24 and/or support 30, spacer 34 helps to insulate platen 24 and other portions of printer 10 from heat generated by at least one heater 40 positioned spaced apart from second surface 38 of support 30. In this embodiment, second surface 38 of support 30 is located between heater 40 and first surface 36 of support 30. Body portion 35 of support 30 is curved. End plates 42 are attached to body portion 35 of support 30 and platen 24 and provide additional structure and stability to support 30. Preferably, body portion 35 of support 30 is made from a metal that suitably conducts heat, for example, aluminum.

In operation, a non-printed side of printed media passes over first surface 36 maintaining contact with first surface 36. As such, first surface 36 defines the media travel path of support 30. In this embodiment, the media travel path is curved creating a directional change in the media travel path of approximately 90°. This helps to maintain contact between media and first surface 36, and to reduce the footprint of printer 10 while maximizing the heating area or zone of support 30 (the portion of support 30, for example, body portion 35 that maintains contact with the printed media). However, the change in direction can be more than 90° or less than 90°. Alternatively, body portion 35 and, therefore, media travel path can be straight.

Figure 5:
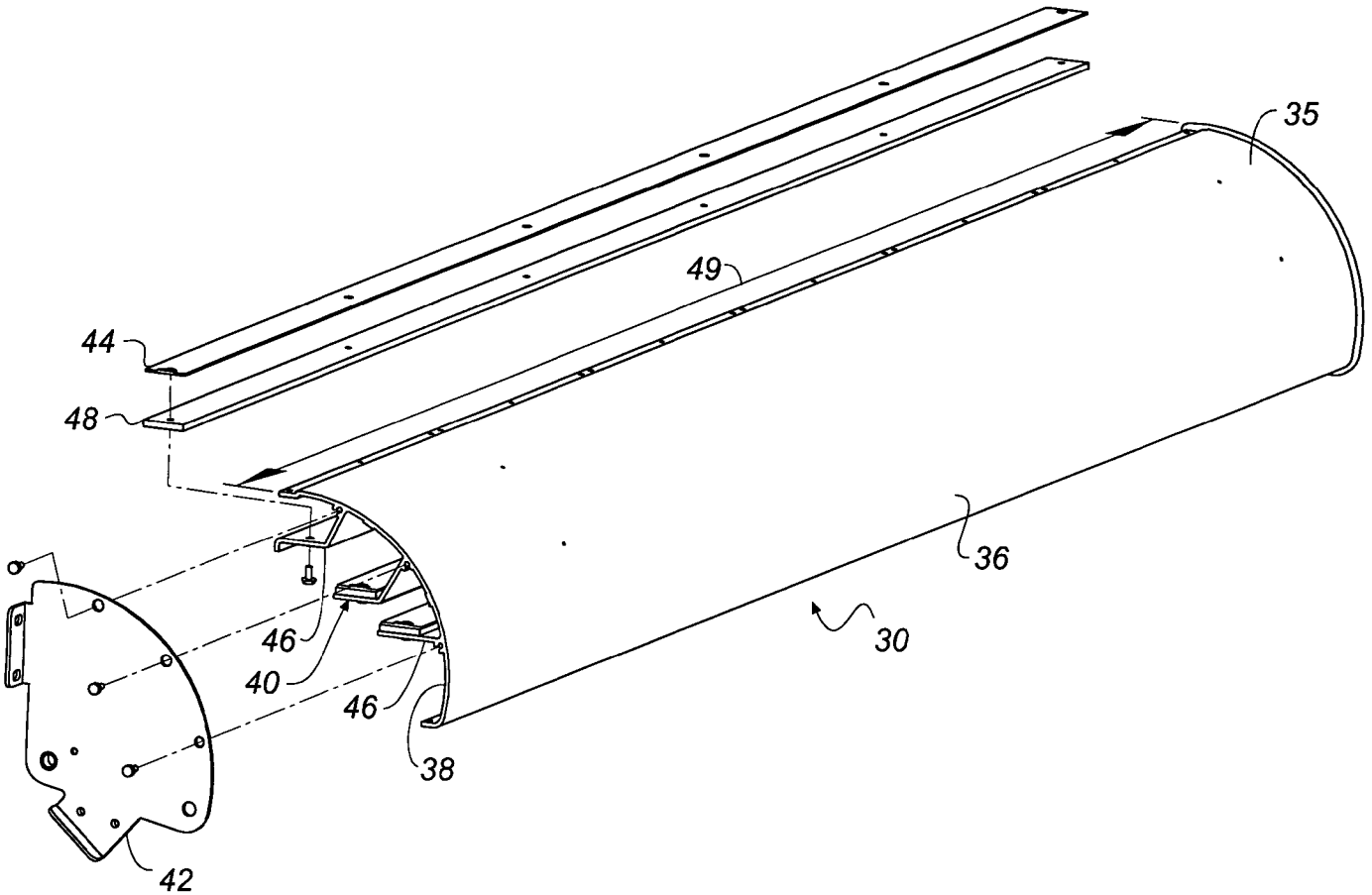
FIG. 5 is an exploded view of the first portion of the media drying system.
Figure 6:
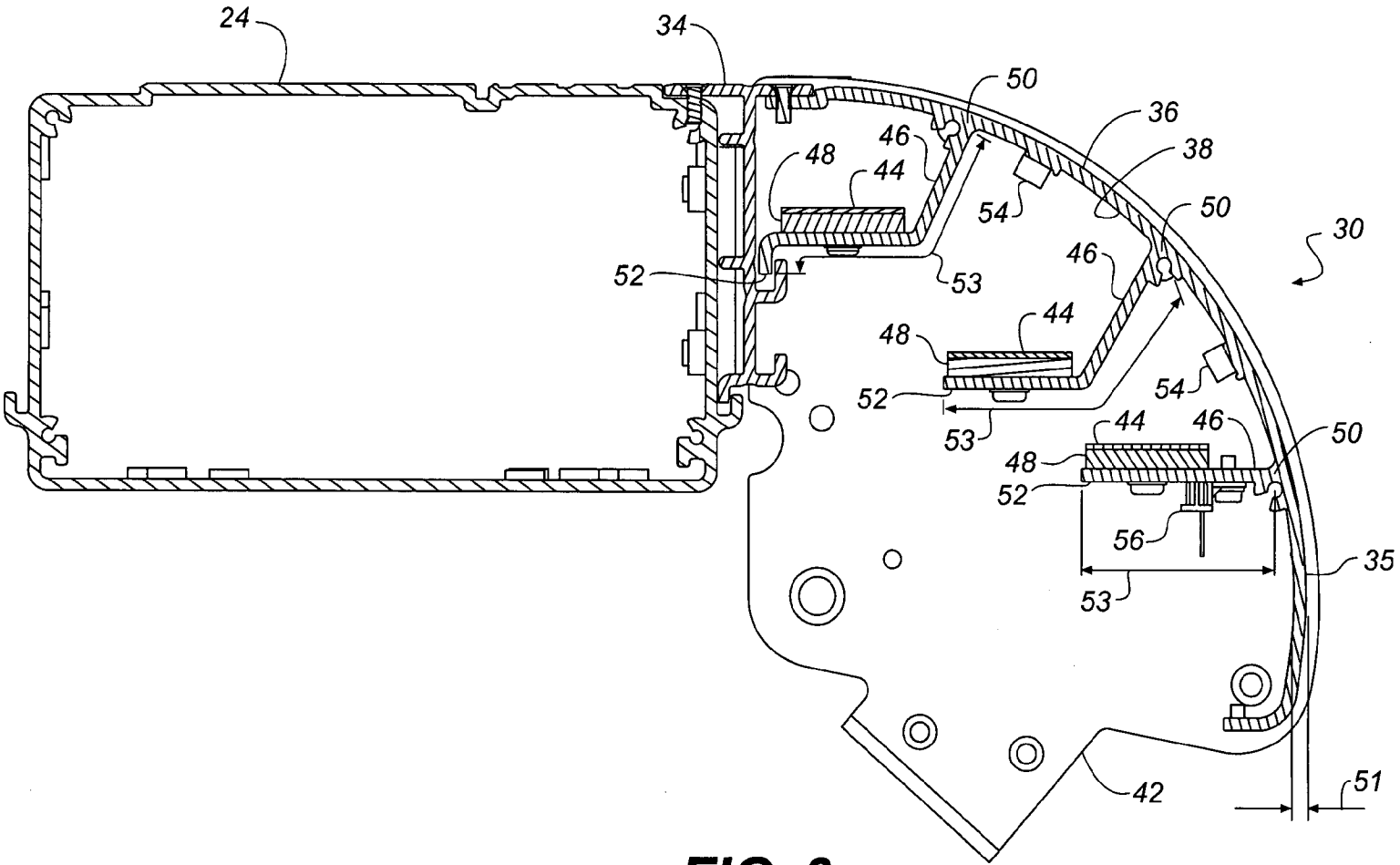
FIG. 6 is a cross sectional view of the first portion of the media drying system.

Referring to FIGS. 5 and 6, heater 40, for example, a heating strip(s) 44, is attached to an extension 46, commonly referred to as a rib. Optionally, a plate 48 can be positioned between heating strip 44 and extension 46. When included, plate 48 provides additional support for heater 40. Preferably, plate 48 and extension 46 are made from a metal that suitably conducts heat, for example, aluminum.

When heater 40 includes heating strip 44, heating strip 44 is typically attached (using glue, etc.) to plate 48. Heating strip 44 and plate 48 are then fixed to extension 46 using any appropriate attachment device (screws, bolt, glue, etc.). Heater 40 can include any type of commercially available heat source. For example, when heating strip 44 is used, heating strip 44 can be of the type commercially available from Minco Products, Inc., Minneapolis, Minn. Heating strip 44 can be rigid or flexible and can be encased in silicone.

In the embodiment shown in FIGS. 5 and 6, heater 40 spans the width 49 of support 30. This helps to provide first surface 36 of support 30 with a uniform heating profile, minimizing areas of first surface 36 that are cooler than other areas of first surface 36. However, other embodiments can include heater(s) 40 that are shorter then the width 49 of support 30. Additionally, heater(s) 40 can overlap each other in order to span the width 49 of support 30.

Heater 40 can be positioned on extension 46 such that extension 46 supports heater 40 (as shown in FIG. 6). Alternatively, heater 40 can be attached to extension 46 in any known manner.

An end 50 of extension 46 is attached to second surface 38 of body portion 35 or integrally formed with body portion 35. Optionally, another end 52 can be affixed to another portion of media drying system 28, for example, spacer 34 or platen 24. Support 30 can be provided with any number of sensors 54 and/or fuses 56 to monitor and control temperature during use.

Extension 46 is suitably shaped to be positioned within support 30. When a plurality of heaters 40 are used with a plurality of extensions 46, one or more of the extensions 46 can be angled in order to accommodate the desired number of heaters 40 and extensions 46. Extension 46 also spans the width 49 of support 30. This helps to provide first surface 36 of support 30 with a uniform heating profile, minimizing areas of first surface 36 that are cooler than other areas of first surface 36. However, other embodiments can include extension(s) 46 that are shorter then the width 49 of support 30. Additionally, extension(s) 46 can overlap each other in order to span the width 49 of support 30.

In operation, heat is conducted from heater strip(s) 44 through extension 46, optionally plate 48, and body portion 35 to a non-printed side of printed media. The media, in turn, is heated causing the evaporation carrier present in the ink of the printed media. Typically, printed media will have areas of high ink carrier concentration and areas of low ink carrier concentration. Surprisingly, the configuration of heater strip(s) 44, extension 46, and body portion 35 of support 30 allows for heat to move from areas of low ink carrier concentration to areas of high ink carrier concentration. Thus, temperature variation of first surface 36 of support 30 is reduced allowing printed media to be dried more quickly and uniformly while allowing for increased media travel speeds through printer 10.

Support 30 has a thickness 51, the distance between first surface 36 and second surface 38. Extension 46 has a length 53, the linear distance between en 50 and end 52. When compared to each other, the length 53 of extension 46 is longer than the thickness 51 of support 30 is wide. Accordingly, the ratio of length 53 to thickness 51 is greater than 1. Surprisingly, this helps produce the improved results described above. It is believed that this type of configuration simulates a support 30 having a thickness that is much thicker than is actually provided. Additionally, the relatively thin thickness 51 of support 30 reduces warm up time associated with the start up of printer 10 while improving temperature control of first surface 36 when support 30 is being heated.

Experimental testing was conducted on an embodiment like the one shown in FIG. 6. In this particular embodiment, the extensions 46 varied in length 53 from 2.1" to 2.8" while the thickness 51 of support 30 was 0.125". As such, a ratio of length 53 to width 51 that varied from 16.5 to 22.4 was produced. Using these length 53 to width 51 ratios helped increase printing speeds by 100% while reducing the power required to adequately dry printed media by 25% when compared to printer(s) 10 that used heated air dryers to evaporate ink carrier.

Figure 7:
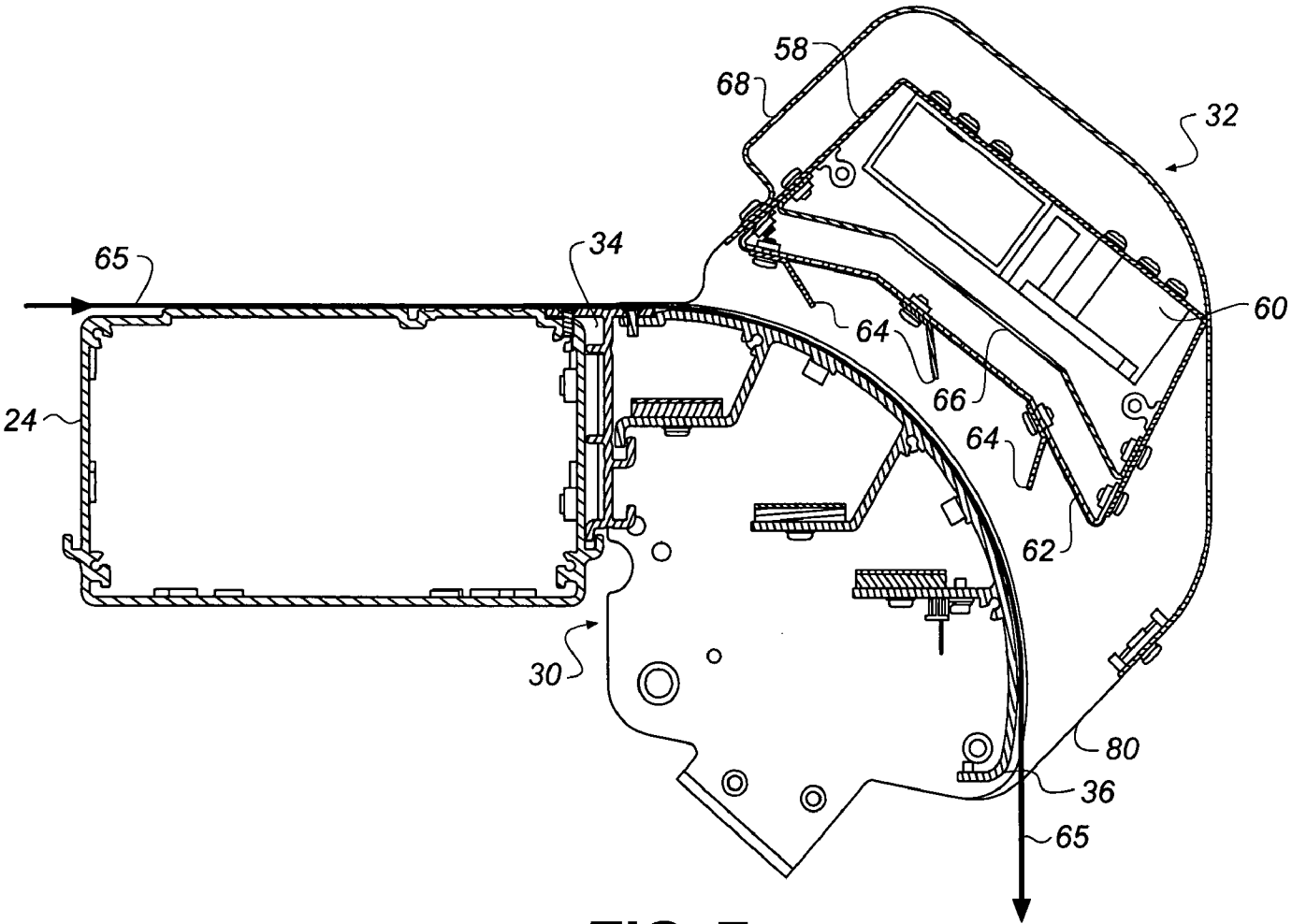
FIG. 7 is a cross sectional view of the media drying system and the platen assembly.
Figure 8:
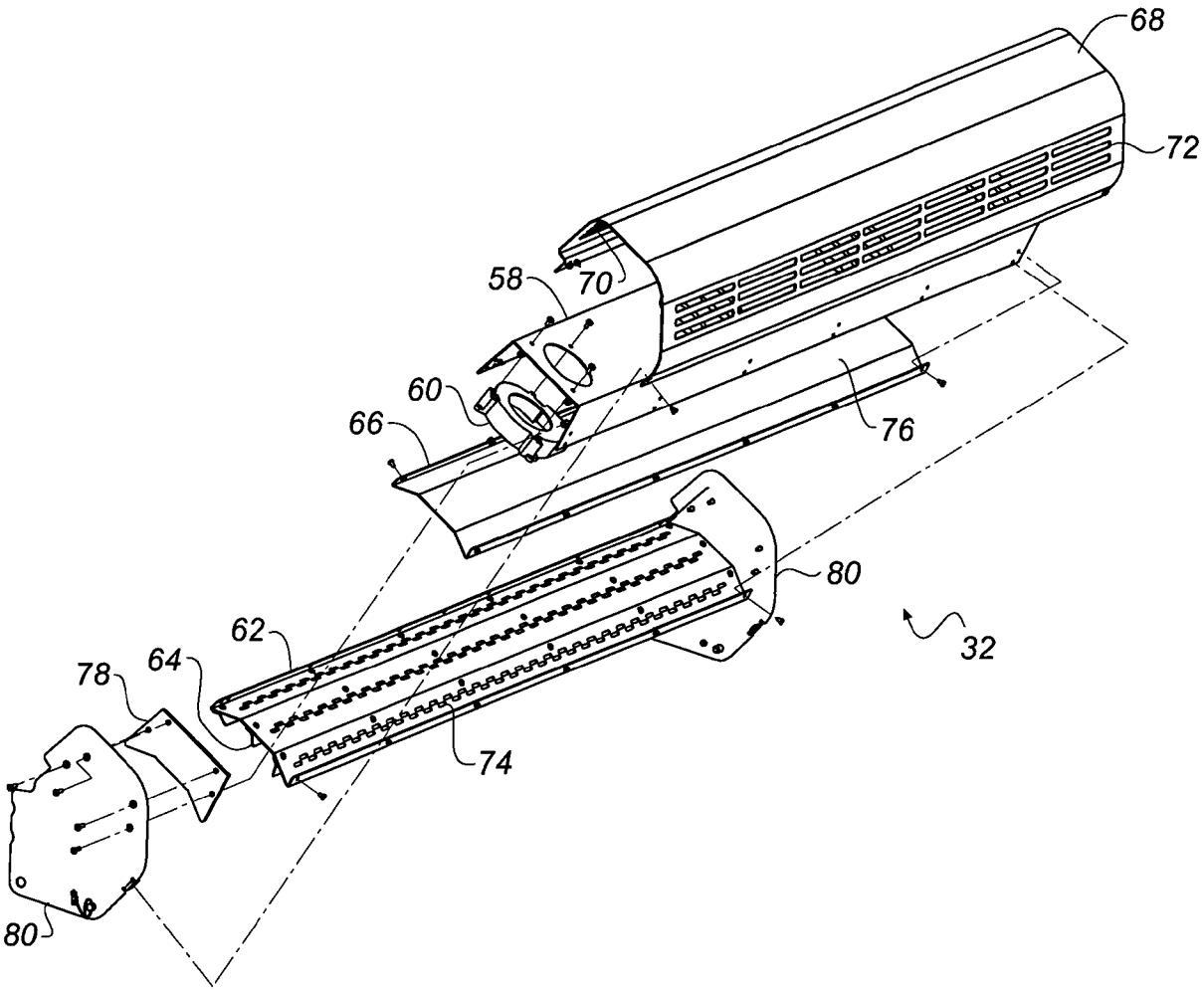
FIG. 8 is an exploded view of a second portion of the media drying system.

Referring to FIGS. 7 and 8, gas dryer 32 is positioned facing first surface 36 of support 30. Gas dryer 32 includes a "C" shaped plenum 58 positioned such that the "C" shape faces the first surface 36 of support 30. Plenum 58 includes a gas source 60, for example, a fan, that generates a gas flow through a nozzle plate 62. Alternatively, gas source 60 can be located removed from and in fluid communication with plenum 58. A plurality of gas flow guides 64, for example, metal or plastic fins, direct the gas flow toward the first surface 36 of support 30. The gas flow guide, for example, a fin, can be positioned at an angle relative to a surface of plenum 58.

The gas flow guide can also be positioned are a angle relative to first surface 36. As such, the gas flow is directed toward first surface 36 of support 30 at an angle relative to a plane tangent to first surface 36. Typically, this angle is less than 90°, preferably 45°, and in a direction of media travel (shown in FIG. 7 using arrow 65). Alternatively, the angle can be perpendicular to first surface 36.

Optionally, plenum 58 can include a restrictor plate 66 positioned between gas source 60 and nozzle plate 62 that regulates the amount of gas directed toward nozzle plate 62. Restrictor plate 66 includes a plurality of gas flow restricting perforations or nozzles 76 that restrict the gas flow generated by gas source 60. Nozzle plate 62 also includes a plurality of perforations or nozzles 74 that are larger when compared to restricting nozzles 76. Restricting nozzles 76 and/or nozzles 74 produces an even and uniform gas flow along the width of the gas dryer 32 which helps to promote uniform drying in a direction substantially perpendicular to the direction of media travel 65. Additionally, heat is carried away from platen 24 (and other printing areas) which helps to reduce media curling (and improve printhead reliability). Nozzles 74, and restricting nozzles 76, can form a pattern in nozzle plate 62, and restrictor plate 66, respectively. The nozzle pattern(s) can be of any form, size, and/or shape suitable to help provide uniform gas distribution toward first surface 36.

A shroud 68 is positioned around plenum 58 and includes a plurality inlets 70 and outlets 72 for gas source 60, for example, a fan. A sealing plate 78 is positioned between a shroud end plate 80 on each end of shroud 68 with shroud end plate 80 being attached to shroud 68.

In operation, the gas flow generated by gas dryer 32 is at a temperature that is cooler (typically, at ambient temperature) than the heated portion (typically, at temperatures exceeding ambient temperature) of body 35. Gas flow impingement on the printed media typically begins after the printed media has traveled over approximately one third of the first surface 36. By doing so, printed media is first heated then contacted with the cooler gas flow to maintain ink carrier evaporation as the media continues to travel over first surface 36 of support 30.

When printed media begins traveling over first surface 36, the media is heated evaporating ink carrier. This increases the moisture content in the region above the media. The gas flow, having a lower humidity than the region above the media, helps to remove moisture from this region which helps to maintain a constant carrier evaporation rate as the media continues to travel over support 30.

While media drying system 28 has been described in the context of an inkjet printer 10, it is contemplated that media drying system 28 is suitable for use with other systems that deposit a fluid including a carrier that is removed or evaporated after the fluid has been deposited.

The invention has been described in detail with particular reference to certain preferred embodiments thereof, but it will be understood that variations and modifications can be effected within the scope of the invention.

What is claimed is:

1. A drying system comprising:

a plenum;

a gas source in fluid communication with the plenum;

a gas flow guide attached to the plenum operable to direct gas flow provided by the gas source, the gas flow having a temperature; and a support having a surface, at least a portion of the surface being heated, the heated surface having a temperature, the gas flow guide being positioned to direct gas flow at least partially toward the heated surface of the support, the temperature of the gas flow being cooler than the temperature of the heated surface, wherein the heated surface of the support is heated by a heater positioned spaced apart from the support, the heater being operatively associated with the support through a conductive path operable to conduct heat from the heater to the support, the conductive path comprising a heat conductive extension connected to the support and to the heater.

2. The system according to claim 1, wherein the gas flow guide includes a fin.

3. The system according to claim 2, the plenum having a surface, wherein the fin is positioned to create an angle relative to the surface of the plenum.

4. The system according to claim 1, wherein the gas flow guide is positioned to create an angle relative to a plane tangential to the surface of the support.

5. The system according to claim 4, wherein the angle is approximately 45°.

6. The system according to claim 1, the support including a width dimension, the system further comprising:

a restrictor plate positioned between the gas flow guide and the plenum, the restrictor plate having at least one perforation sized to distribute gas flow over the surface of the support in the width dimension.

7. The system according to claim 1, further comprising:

a restrictor plate positioned between the gas flow guide and the plenum, the restrictor plate having at least one perforation sized to limit gas flow from the gas flow generated by the gas source to the gas flow guide.

8. The system according to claim 7, wherein the at least one perforation forms a pattern of perforations through the restrictor plate.

9. The system according to claim 7, further comprising:

a nozzle plate positioned between the restrictor plate and the gas flow guide, the nozzle plate having at least one perforation sized to direct gas flow to the gas flow guide.

10. The system according to claim 1, wherein the gas source is positioned within the plenum.

11. The system according to claim 10, wherein the gas flow generator includes a fan.

12. The system according to claim 1, wherein the gas source is positioned remotely relative to the plenum and is in fluid communication with the plenum.

13. The system according to claim 1, further comprising:

a cover positioned at least partially about the plenum, the cover including a gas inlet and a gas outlet.

14. The system according to claim 1, the heated surface having an origin, wherein the gas flow guide includes a plurality of fins that direct gas toward the heated surface at a location spaced apart from the origin of the heated surface.

15. The system according to claim 1, portions of the surface of the support defining a direction of media travel, wherein the gas flow guide is positioned to direct gas at least partially along the direction of media travel.

16. The system according to claim 1, the support having a thickness, the extension having a length, wherein a ratio of the length of the extension to the thickness of the media support is greater than 1.

17. A method of drying media comprising:

providing a surface, a portion of the surface defining a media travel path;

heating the portion of the surface defining the media travel path, the heated portion of the surface having a temperature; and directing a gas flow having a temperature at least partially toward the surface and at least partially along a direction of media travel, the temperature of the gas flow being cooler than the temperature of the heated portion of the surface, wherein heating the portion of the surface defining the media travel path includes conducting heat from a source of heat through a heat conductive extension connected to the source of heat and the portion of the surface defining the media travel path.

18. The method according to claim 17, wherein directing the gas flow at least partially toward the surface includes directing the gas flow to a location of the surface downstream from a location of the surface where heating begins, downstream being relative to the direction of media travel.

19. The method according to claim 17, wherein the gas flow is at an ambient temperature.

20. A drying system comprising:

a plenum;

a gas source in fluid communication with the plenum;

a gas flow guide attached to the plenum operable to direct gas flow provided by the gas source;

a restrictor plate positioned between the gas flow guide and the plenum, the restrictor plate having at least one perforation sized to limit gas flow from the gas flow generated by the gas source to the gas flow guide;

a nozzle plate positioned between the restrictor plate and the gas flow guide, the nozzle plate having at least one perforation sized to direct gas flow to the gas flow guide; and a support having a surface, at least a portion of the surface being heated, wherein the gas flow guide is positioned to direct gas flow at least partially toward the heated surface of the support.

21. The system according to claim 20, wherein the gas flow guide includes a fin.

22. The system according to claim 20, the heated surface having an origin, wherein the gas flow guide includes a plurality of fins that direct gas toward the heated surface at a location spaced apart from the origin of the heated surface.

* * * * *